US012037721B2

(12) United States Patent
Caridi

(10) Patent No.: US 12,037,721 B2
(45) Date of Patent: Jul. 16, 2024

(54) TERRY FABRIC HAVING SURFACES WITH VARYING PILE WEIGHTS

(71) Applicant: Sobel Westex, Las Vegas, NV (US)

(72) Inventor: Roberto Caridi, New York, NY (US)

(73) Assignee: Sobel Westex, Las Vegas, NV (US)

( * ) Notice: Subject to any disclaimer, the term of this patent is extended or adjusted under 35 U.S.C. 154(b) by 0 days.

(21) Appl. No.: 16/784,107

(22) Filed: Feb. 6, 2020

(65) Prior Publication Data

US 2020/0248345 A1 Aug. 6, 2020

Related U.S. Application Data

(60) Provisional application No. 62/802,026, filed on Feb. 6, 2019.

(51) Int. Cl.

| | |
|---|---|
| ***D03D 27/08*** | (2006.01) |
| ***D03D 1/00*** | (2006.01) |
| ***D03D 13/00*** | (2006.01) |

(52) U.S. Cl.

CPC ..... *D03D 27/08* (2013.01); *D03D 1/0017* (2013.01); *D03D 13/008* (2013.01)

(58) Field of Classification Search

CPC .... D03D 27/08; D03D 13/008; D03D 1/0017; D03D 2700/0177; D03D 15/43

See application file for complete search history.

(56) References Cited

U.S. PATENT DOCUMENTS 1,831,812 A * 11/1931 Leach ..... D03D 27/00 28/166
2,814,314 A * 11/1957 Harding ..... D03D 27/06 139/39
RE24,949 E * 3/1961 Clark ..... D03D 27/06 139/46
3,030,691 A * 4/1962 Law ..... D03D 27/08 428/95
3,302,665 A * 2/1967 Mchargue ..... D03D 27/08 139/396
3,343,242 A * 9/1967 De Witte ..... D06P 5/001 28/169
3,721,272 A * 3/1973 Hager ..... D03D 27/08 26/69 R
3,721,273 A * 3/1973 Sherrill ..... D03D 27/08 26/69 R (Continued)

OTHER PUBLICATIONS http://textilefashionstudy.com/scouring-definition-objectives-effects-and-methods-of-scouring/; Scouring, Definition objectives, effects and methods of scouring; Feb. 16, 2012. Accessed Apr. 26, 2021. (Year: 2012).*

*Primary Examiner* — Robert H Muromoto, Jr.

(74) *Attorney, Agent, or Firm* — Howard & Howard Attorneys PLLC

(57) ABSTRACT

A terry fabric having a top surface and a bottom surface. The top surface includes a first yarn having a first pile weight. The top surface has a first surface weight. The bottom surface includes a second yarn having a second pile weight. The bottom surface has a second surface weight. The first yarn is coarser than the second yarn, and the first pile weight is greater than the second pile weight. The first surface weight is greater than the second surface weight. A combined weight of the top surface and the bottom surface of the terry fabric is less than two times the first pile weight but greater than the second pile weight.

2 Claims, 5 Drawing Sheets

500

| SMART TOWEL | | | | | | | | | | |
|---|---|---|---|---|---|---|---|---|---|---|
| | NE | COUNT | PILE MTERS | METR.DIF | WEIGHT DIF.GMS. | WEIGHT PILE SURFACES | WEFT WEIGHT | GROUND WEIGHT | TOTAL FRONT WEIGHT | TOTAL BACK WEIGHT |
| TOP SURFACE | 12/1 OESOFTS | 12 | 3733 | 1,244 | 46 | 214 | 89.91 | 98.80 | 616 | 445 |
| BACK SURFACE | 16/1 OESOFTS | 16 | 4978 | | | 128 | | | | |

| | | POUNDS/ DOZEN | GRAMS/ M2 |
|---|---|---|---|
| 12/10ESOFTS | FRONT WEIGHT | 16.30 | 615 |
| 16/10ESOFTS | BACK WEIGHT | 11.78 | 445 |
| | REAL WEIGHT | 14.04 | 530 |

(56) References Cited

U.S. PATENT DOCUMENTS 3,721,274 A * 3/1973 Sherrill ..... D03D 27/08 26/69 R
4,415,611 A * 11/1983 Yamagata ..... D04H 11/00 28/162
4,525,403 A * 6/1985 Hynek ..... D06N 3/004 451/28
4,624,675 A * 11/1986 Irmer ..... D03D 27/00 8/138
4,670,317 A * 6/1987 Greenway ..... D06C 23/00 428/152
4,726,400 A * 2/1988 Heiman ..... D03D 27/08 139/396
5,447,182 A * 9/1995 Gehrig ..... D03D 27/08 139/396
5,667,865 A * 9/1997 Jackson ..... D03D 27/08 8/537
5,722,465 A * 3/1998 Herrlein ..... D03D 39/223 139/26
5,966,757 A * 10/1999 Sullivan ..... A47G 9/062 5/419
6,062,272 A * 5/2000 Waite ..... D03D 27/00 428/92
6,063,473 A * 5/2000 Zafiroglu ..... B29C 70/24 428/95
6,112,773 A * 9/2000 Geiger ..... D03D 39/226 139/26
6,305,431 B1 * 10/2001 Fenkes ..... A47L 13/16 139/391
6,546,965 B2 * 4/2003 Hamby ..... D03D 27/08 139/420 A
7,044,173 B2 * 5/2006 Silver ..... A47K 10/02 139/420 R
7,067,184 B1 * 6/2006 Carkeek ..... A47G 23/03 428/101
7,565,821 B2 * 7/2009 Park ..... F25B 21/04 66/195
7,601,655 B2 * 10/2009 Katsin ..... B32B 5/06 428/92
7,673,656 B2 * 3/2010 Heiman ..... D03D 27/08 139/420 R
7,850,741 B2 * 12/2010 Park ..... D03D 15/00 57/332
8,578,972 B2 * 11/2013 Duan ..... D03D 15/33 139/420 R
8,596,305 B2 * 12/2013 Govindaswamy ..... D03D 15/68 139/420 R
8,631,833 B2 * 1/2014 Garbarino ..... D06H 5/00 139/420 R
9,044,917 B1 * 6/2015 Terracino ..... A47G 27/0206
9,828,704 B2 * 11/2017 Goenka ..... D03D 27/08
9,850,599 B2 * 12/2017 Stewart ..... D03D 27/08
10,072,364 B2 * 9/2018 Goenka ..... D03D 27/08
10,655,251 B2 * 5/2020 Dalton ..... B32B 7/12
11,408,100 B2 * 8/2022 Vanunu ..... D03D 27/08
2002/0122914 A1 * 9/2002 Rock ..... D04B 1/02 428/85
2002/0124365 A1 * 9/2002 Wood ..... D06C 29/00 28/162
2003/0024093 A1 * 2/2003 Willauer, Jr. ..... D06C 23/00 28/169
2003/0089097 A1 * 5/2003 Lee ..... D02G 3/38 57/3
2004/0086683 A1 * 5/2004 Higgins ..... D06N 7/0086 428/95
2005/0081938 A1 * 4/2005 Krumm ..... D03D 39/226 139/25
2011/0017341 A1 * 1/2011 Terracino ..... A47G 27/0206 139/383 R
2011/0111666 A1 * 5/2011 Kim ..... D03D 15/47 112/439
2012/0208416 A1 * 8/2012 Lerman ..... A47G 27/0225 442/1
2012/0255643 A1 * 10/2012 Duan ..... D03D 15/33 66/93
2013/0115841 A1 * 5/2013 Ronner ..... D06C 15/02 28/165
2014/0255643 A1 * 9/2014 Koot ..... B32B 5/026 428/86
2014/0317865 A1 * 10/2014 Krishna ..... D03D 15/573 15/209.1
2015/0291074 A1 * 10/2015 Taguchi ..... D06N 7/0065 428/89
2017/0073858 A1 * 3/2017 Goenka ..... D03D 1/0017
2018/0155868 A1 * 6/2018 Michinobu ..... D06M 15/643
2020/0232128 A1 * 7/2020 Lawrence ..... D03D 1/0017
2020/0248345 A1 * 8/2020 Caridi ..... D03D 13/008

* cited by examiner

400

TECHNICAL CARD

SMART TOWEL

MEASURES IN CMS.

71 X 141

REED 12

| | | | | |
|---|---|---|---|---|
| GROUND COUNT | Ne. 10/1 OE | | | |
| PILE COUNT | Ne. 12/1 & Ne. 16/1 | | | |
| PILE PICK | 108 | 1192 | 108 | 16/10E COTTON |
| PILE PICK | 54 | 596 | 54 | 12/10E COTTON |
| BORDER PICKS 1 | 75 | 75 | | 10/10E COTON |
| | | | 24/2 WHITE | |
| BORDERS PICKS 2 | 75 | 75 | POLY | |
| # OF BORDERS | 2 | | | |
| BORDER WIDTH | 2.5 CMS. | | | |
| BORDER WIDTH | 2.5 CMS. | | | |
| SEPARATION PICKS | 48 | 6 | 48 | 16/10E COTTON |
| SEPARATION PICKS | 24 | | 24 | 12/10E COTTON |
| TOTAL PICKS | 2556 | | | |
| PICKS PER CMS | 15.0 | | | |
| REED WIDTH | 254.8 | | | |
| # GROUND WARP | 3298 ENDS | | | END HEM |
| # PILE WARP | 2826 ENDS | | | |
| SELVAGE # ENDS | 76 X 6 | | | ZIGZAG TWILL |
| UNIT WEIGT (GRAMS) | 583 | | | |
| FINISHING WEIGT | 530 | | | |
| WEIHT / M2 | 530 | | | |
| UNITS TO THE LOOM | | | | |
| WIDT | 3 | | | |
| REMARKS | | | | |
| DRAW IN | STRAIGHT DRAW | | | |

FIG. 4

500

| SMART TOWEL | | | | | | | | | | |
|---|---|---|---|---|---|---|---|---|---|---|
| | NE | COUNT | PILE MTERS | METR.DIF | WEIGHT DIF.GMS. | WEIGHT PILE SURFACES | WEFT WEIGHT | GROUND WEIGHT | TOTAL FRONT WEIGHT | TOTAL BACK WEIGHT |
| TOP SURFACE | 12/1 OESOFTS | 12 | 3733 | 1,244 | 46 | 214 | 89.91 | 98.80 | 616 | 445 |
| BACK SURFACE | 16/1 OESOFTS | 16 | 4978 | | | 128 | | | | |

| | | POUNDS/ DOZEN | GRAMS/ M2 |
|---|---|---|---|
| 12/10ESOFTS | FRONT WEIGHT | 16.30 | 615 |
| 16/10ESOFTS | BACK WEIGHT | 11.78 | 445 |
| | REAL WEIGHT | 14.04 | 530 |

FIG. 5

TERRY FABRIC HAVING SURFACES WITH VARYING PILE WEIGHTS

CROSS-REFERENCE TO RELATED APPLICATION

This application claims the benefit of U.S. Provisional Patent Application No. 62/802,026, filed Feb. 6, 2019, which is hereby incorporated by reference in its entirety.

FIELD OF THE DISCLOSURE

The present disclosure relates generally to fabrics, and more specifically, to a terry fabric having surfaces with varying pile weights.

BACKGROUND

Terry fabrics have traditionally been used for making towels due to their durability and ability to absorb water. However, terry fabrics are difficult and expensive to launder because of these qualities. Laundering terry fabrics effectively calls for significant amounts of detergent, water, and heat or drying time compared to other fabrics. To overcome these challenges, it has been desirable to reduce the overall weight of the fabric, and thus, the weight of the towel. However, in traditional terry fabrics, the weight of pile is distributed evenly between the two faces of the fabric, i.e., 50% pile weight on one face of the fabric and 50% pile weight on the opposite face of the fabric. In other designs, a single face of the fabric may have pile weight distributed differently (e.g., in bands with varying pile weights across the face of the fabric). However, this affects the overall appearance and feel of the fabric, and it also limits the versatility of the fabric during manufacturing by, for example, limiting what borders might be used on the fabric based on the pile weight distribution.

The present disclosure is aimed at solving one or more of the problems identified above.

BRIEF DESCRIPTION OF THE DRAWINGS

Advantages of the present disclosure will be readily appreciated, as the same becomes better understood by reference to the following detailed description, when considered in connection with the accompanying drawings. Non-limiting and non-exhaustive embodiments of the present disclosure are described with reference to the following figures, wherein like numerals refer to like parts throughout the various views unless otherwise specified.

FIG. 4 is a technical card including specifications of the representative towel of FIG. 1; and FIG. 5 is a table including weight calculations based on the specifications of the technical card of FIG. 4.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an examples" means that a particular feature, structure or characteristic described in connection with the embodiment of example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The present disclosure particularly describes a terry fabric having a different pile weight on each face of the fabric. Despite the differing pile weight on each face of the fabric, the fabric may have the same pile height on both faces. Thus, the fabric of the present invention achieves a high-volume appearance towel with low overall weight. This construction provides effective absorption on the top surface, which may be used primarily for drying, while the bottom surface may be used for rubbing or other action that requires more friction. These two different surfaces are provided in a single towel, fulfilling the complete purpose for which a towel is needed. The low overall weight of the fabric decreases the cost of laundering articles made of the fabric. However, the face of the fabric used for drying feels luxurious to the user, so the user experience is not negatively affected. Additionally, the fabric remains versatile for manufacturing purposes. For example, any border may be used on an article made from the fabric because the pile weight is consistent across a single face of the fabric.

Figure 1:
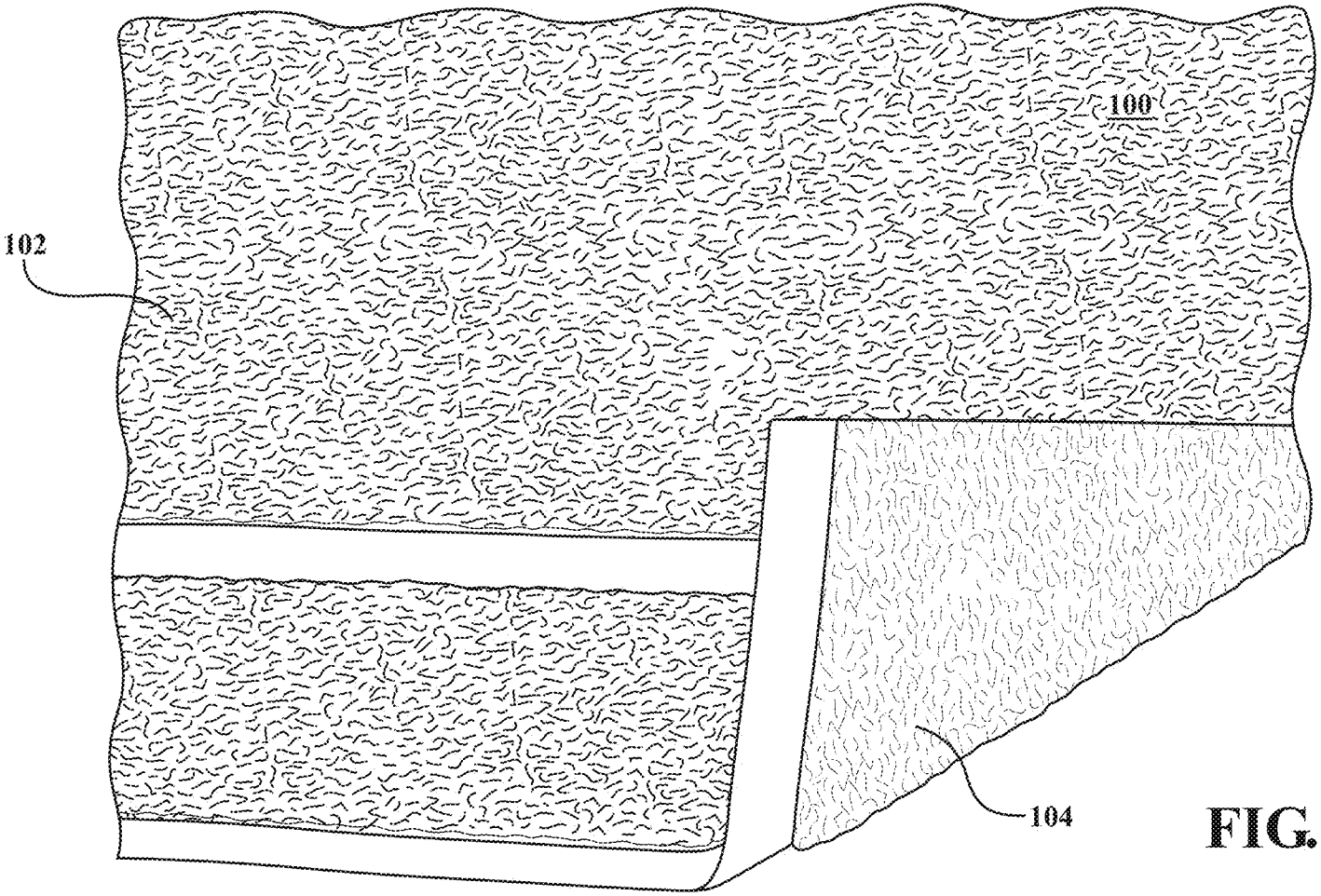
FIG. 1 is a perspective view of a partial representative towel with the terry fabric construction according to a first embodiment.

Referring now to FIG. 1, a perspective view of a representative towel with the terry fabric construction according to a first embodiment is shown. With this fabric construction, the surfaces of towel 100 appear to have different volumes, rather than a uniform volume on both surfaces of the fabric. This is possible by using a coarser/heavier yarn on a top surface 102 and a thinner/lighter yarn on a bottom surface 104. However, it will be understood that in other embodiments, a fabric construction may be used such that surfaces of towel 100 appear to have the same volume, despite varying differing pile weight on each surface. This is achieved by using a fabric with the same pile height on both surfaces 102, 104.

The thinner yarn is conditioned before processing in the warping stage, and a special tension adjustment on looms is used. The thinner yarn is scoured to remove the color from the yarn, so that it may be differentiated from the coarser yarn during the weaving process. After being scoured, the thinner yarn is then laid on warper reed with the thicker yarn with a draw-in one by one, keeping this order on sizing stage and weaving. This process of scouring permits both type of yarns used for the fabric construction, making it easier to direction them on the corresponding shafts of the loom, whose movement determines pile formation on each surface of the fabric.

Figure 2:
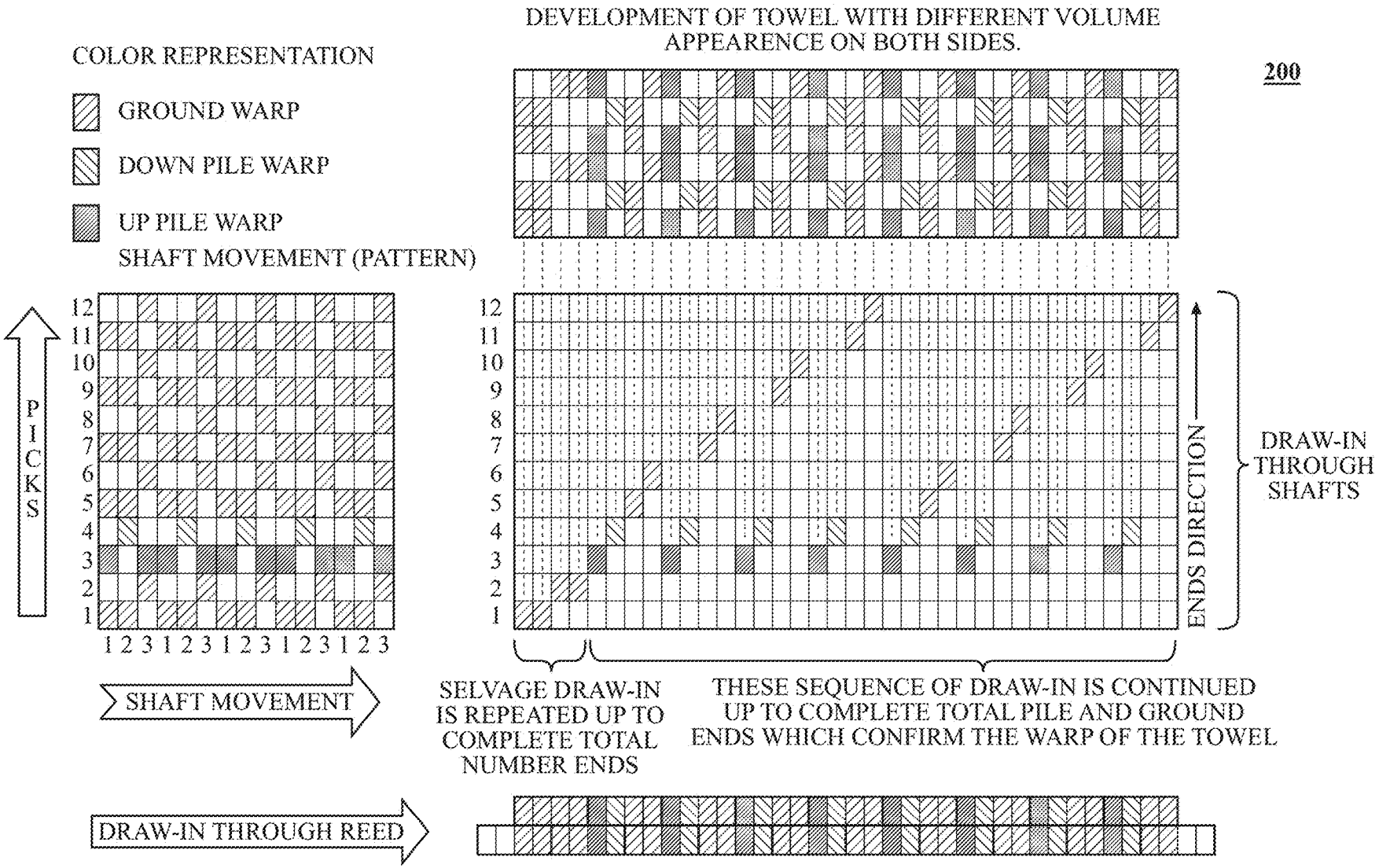
FIG. 2 is a weave design schematic according to the first embodiment.

Referring now to FIG. 2, a weave design schematic according to the first embodiment is shown. The schematic 200 includes weave design, pattern or shaft movement order, draw-in on shaft and reed. Ground ends are disposed with a straight draw, allowing a variety of designs on borders, just modifying the pattern on this area of the fabric.

Figure 3:
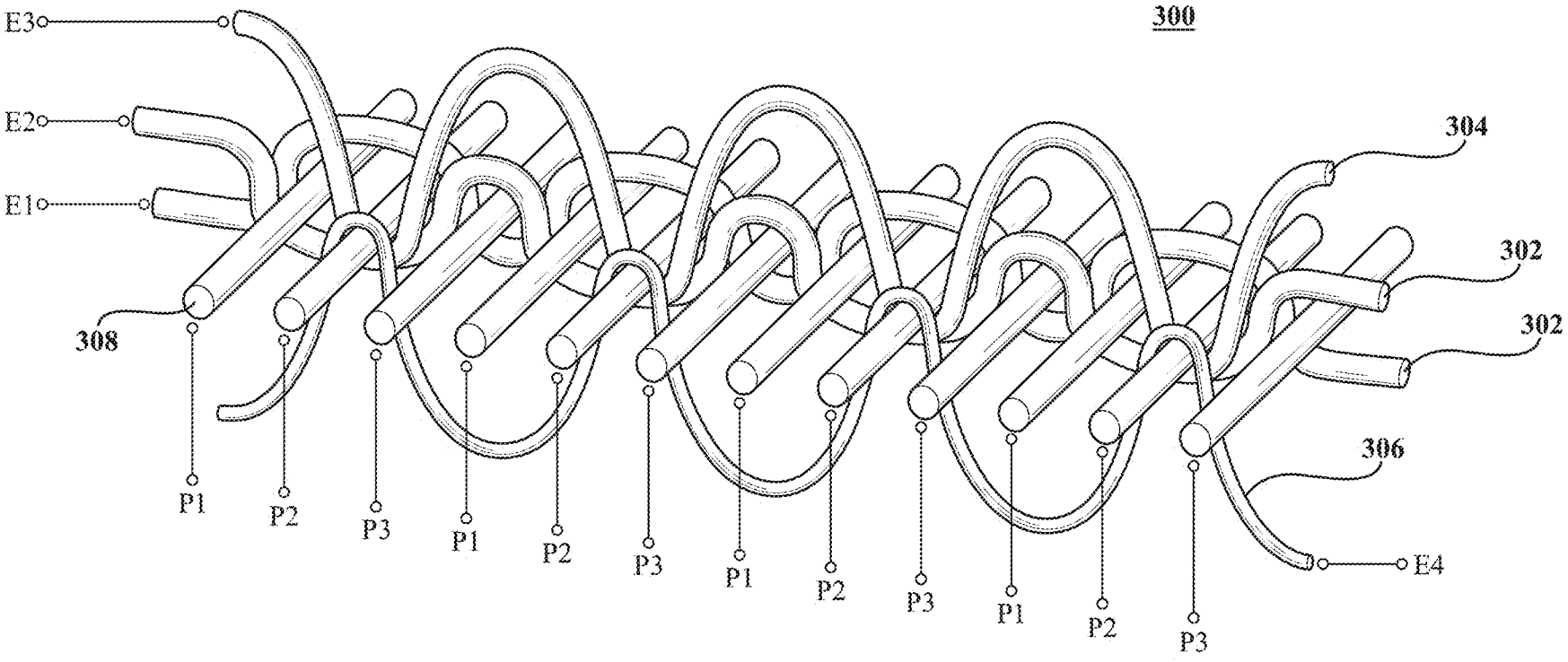
FIG. 3 is a partial, three-dimensional, not-to-scale view of the weave components of the terry fabric according to FIG. 1.

Referring now to FIG. 3, a partial, three-dimensional, not-to-scale view of the weave components of the terry fabric according to FIG. 1 is shown. The weave 300 is a three-pick pile cycle terry weave. Ground warp ends E1 and E2 are comprised of a first yarn 302. Top pile end E3 is comprised of a second yarn 304, which may be a coarse yarn. Bottom pile end E4 is comprised of a third yarn 306, which may be thinner yarn than second yarn 304. Ground fill picks P1, P2, and P3 are comprised of a fourth yarn 308.

Referring now to FIG. 4, a technical card including specifications of the representative towel of FIG. 1 is shown. Technical card 400 meets main specifications of towel 100, which determines length, width and weight. It also contains the type of ends used on warp and weft, and their respective densities. For example, in the illustrated embodiment, the top pile yarn (e.g., second yarn 304 of FIG. 3) is 12s cotton yarn, and the bottom pile yarn (e.g., third yarn 306 of FIG. 3) is 16s cotton yarn. It will be understood that the specifications on technical card 400 could be modified depending on the desired final weight and dimension of towel 100. The specifications shown in FIG. 4 are for illustrative purposes only and are in no way limiting.

Referring now to FIG. 5, a table including weight calculations based on the specifications of the technical card of FIG. 4 is shown. In the illustrated embodiment, table 500 shows the final weight of towel 100 is 14.04 pounds/dozen, with a top weight of 16.3 pounds/dozen and a bottom weight of 11.78 pounds/dozen, based on the use of 12s and 16s cotton yarns for the top and bottom pile yarns, respectively. Thus, the total weight of the towel is less than two times the weight of the heavier surface but greater than the weight of the lighter surface. Therefore, although the overall weight of the towel is about 14 pounds, it has the quality of an approximately 16-pound towel on one face and an approximately 12-pound towel on the reverse face. Thus, the towel may be sold having the value of 16-pound towel for the price of a 14-pound towel.

It will be understood that the calculations in table 500 are based on specifications of technical card 400 of FIG. 4, and that such calculations would change as the specifications of technical card 400 are modified. For example, the desired overall weight of the towel (or other article) may be more or less than 14 pounds, as shown, and therefore varying the desired overall weight of the towel would require adjustments of all other values, all of which may be completely customizable. The calculations shown in FIG. 5 are for illustrative purposes only and are in no way limiting.

While the foregoing descriptions have discussed towels, it should be recognized that the fabric of the present invention may be used for any suitable linen or item of manufacture for which terry cloth is or could be used.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any articles or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A terry fabric consisting of:
   - a top surface having a top pile yarn with a single first pile weight and a single first pile height throughout the top surface; and
   - a bottom surface opposite the top surface having a bottom pile yarn with a single second pile weight and a single second pile height throughout the bottom surface, wherein:
     - the top pile yarn is greater in thickness than the bottom pile yarn;
     - the first pile weight is greater than the second pile weight;
     - the first pile height is equal to the second pile height; and
     - a combined weight of the top surface and the bottom surface of the terry fabric is less than two times the first pile weight but greater than the second pile weight.

2. A method of weaving terry fabric, the method consisting of:
   - scouring a bottom pile yarn; and
   - weaving the bottom pile yarn together with a top pile yarn, wherein the top pile yarn is thicker than the bottom pile yarn, to form a terry fabric having a top surface opposite a bottom surface, wherein the top pile yarn forms the top surface with a single first pile weight and a single first pile height throughout the top surface, the bottom pile yarn forms the bottom surface opposite the top surface having a single second pile weight and a single second pile height throughout the second surface, the first pile weight is greater than the second pile weight, and wherein the single pile height of the top surface is equal to the single pile height of the bottom surface and a combined weight of the top surface and the bottom surface of the terry fabric is less than two times the first pile weight but greater than the second pile weight.

* * * * *